US009843133B2

(12) United States Patent
Kashani et al.

(10) Patent No.: US 9,843,133 B2
(45) Date of Patent: Dec. 12, 2017

(54) CONNECTOR RETENTION FEATURES FOR REDUCED WEAR

(71) Applicant: Apple Inc., Cupertino, CA (US)

(72) Inventors: Mani Razaghi Kashani, Cupertino, CA (US); Paul J. Hack, San Jose, CA (US); Zheng Gao, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/626,928

(22) Filed: Feb. 20, 2015

(65) Prior Publication Data

US 2015/0236446 A1 Aug. 20, 2015

Related U.S. Application Data

(60) Provisional application No. 61/942,585, filed on Feb. 20, 2014, provisional application No. 61/944,547, filed on Feb. 25, 2014.

(51) Int. Cl.
*H01R 13/627* (2006.01)
*H01R 13/635* (2006.01)

(52) U.S. Cl.
CPC ..... *H01R 13/635* (2013.01); *H01R 13/6275* (2013.01)

(58) Field of Classification Search
CPC .. H01R 13/6275; H01R 13/20; H01R 13/639; H01R 13/6272; H01R 13/518
USPC ..... 439/345–347, 352–358
See application file for complete search history.

(56) References Cited

U.S. PATENT DOCUMENTS 4,634,204 A * 1/1987 Detter ..... H01R 13/641 439/347
5,564,939 A * 10/1996 Maitani ..... H01R 13/6335 439/352
6,113,415 A * 9/2000 Bertsch ..... H01R 13/514 439/353
6,244,889 B1 * 6/2001 James ..... H01R 13/6275 439/258
6,361,363 B1 * 3/2002 Hwang ..... H01R 13/6485 439/352
6,394,842 B1 * 5/2002 Sakurai ..... H01R 23/688 439/352
6,447,170 B1 * 9/2002 Takahashi ..... H01R 13/6273 385/53

(Continued)

*Primary Examiner* — Thanh Tam Le
(74) *Attorney, Agent, or Firm* — Kilpatrick Townsend & Stockton LLP

(57) ABSTRACT

Connector inserts having latches, bayonets, or similar structures as retention features. The connector inserts may include these bayonets on one or more sides or other portions of the connector insert. The bayonets may be located inside of a connector insert while the connector insert is being inserted into a receptacle, thereby reducing wear and marring of the receptacle. The bayonets may extend out of a connector insert when the connector insert is inserted into the connector receptacle and may engage corresponding retention features in the connector receptacle, thereby reducing the chances of an inadvertent disconnection. When the bayonets are located inside the connector insert, the connector insert may be in a first state, while when the bayonets are extended, the connector insert may be in a second state. The connector insert may retain state in either the first or second state in the absence of a user applied force.

24 Claims, 12 Drawing Sheets

(56) References Cited

U.S. PATENT DOCUMENTS

| | | | | |
|---|---|---|---|---|
| 6,558,183 | B1 * | 5/2003 | Ji | H01R 13/6275 439/358 |
| 6,799,986 | B2 * | 10/2004 | Igarashi | H01R 13/6275 439/358 |
| 7,025,620 | B2 * | 4/2006 | Li | H01R 13/6275 439/358 |
| 7,074,070 | B1 * | 7/2006 | Huang | H01R 13/65802 439/352 |
| 7,112,103 | B2 * | 9/2006 | Zhang | H01R 13/2428 439/700 |
| 7,144,267 | B1 * | 12/2006 | Huang | H01R 13/6275 439/352 |
| 7,163,412 | B2 * | 1/2007 | Fan | H01R 13/6205 439/258 |
| 7,351,089 | B2 * | 4/2008 | Neale, III | H01R 13/6277 439/352 |
| 7,500,864 | B2 * | 3/2009 | Mase | H01R 13/6272 439/352 |
| 7,549,887 | B1 * | 6/2009 | Ng | H01R 13/6272 439/352 |
| 7,850,476 | B2 * | 12/2010 | Good | H01R 13/639 136/251 |
| 8,303,326 | B1 * | 11/2012 | McKee | H01R 13/6275 439/358 |
| 8,591,247 | B2 * | 11/2013 | Zhu | H01R 13/6273 439/352 |
| 9,039,437 | B2 * | 5/2015 | Kurumizawa | H01R 13/6397 439/352 |

* cited by examiner

CONNECTOR RETENTION FEATURES FOR REDUCED WEAR

CROSS-REFERENCES TO RELATED APPLICATIONS

This application is a non-provisional of U.S. provisional patent applications 61/942,585, filed Feb. 20, 2014, and 61/944,547, filed Feb. 25, 2014, which are incorporated by reference.

BACKGROUND

The amount of data transferred between electronic devices has grown tremendously the last several years. Large amounts of audio, streaming video, text, and other types of data content are now regularly transferred among desktop and portable computers, media devices, handheld media devices, displays, storage devices, and other types of electronic devices. Power supply voltages and ground may be transferred with this data.

Power and data may be conveyed over cables that may include wire conductors, fiber optic cables, or some combination of these or other conductors. Cable assemblies may include a connector insert at each end of a cable, though other cable assemblies may be connected or tethered to an electronic device in a dedicated manner. The connector inserts may be inserted into receptacles in the communicating electronic devices.

It may be desirable that a connector insert not accidently disconnect from a connector receptacle during device operation. For example, during a large data transfer, if a connector insert disconnects from a connector receptacle, the transfer may become corrupted. This may require a transfer restart thereby costing a user time and may diminish the user's opinion of the electronic devices involved.

Unfortunately, these retention features may wear or mar one or more surfaces on a corresponding connector. That is, retention features on one surface may repeatedly engage a surface on a corresponding connector. This repeated engagement may diminish the appearance of the corresponding connector, and may eventually cause damage or reduced functionality to the corresponding connector and the device or cable that it is part of. This may be particularly undesirable where a connector insert on a cable may wear or mar a connector receptacle on a device. Retention features that wear or mar a connector receptacle on the electronic device may cause the electronic device to appear prematurely obsolete or dated and may diminish a user's enjoyment of the device.

Thus, what is needed are inserts, receptacles, and apparatus for connector systems that have retention features that wear or mar corresponding connectors to a reduced degree.

SUMMARY

Accordingly, embodiments of the present invention may provide inserts, receptacles, and apparatus for connector systems that have retention features that wear or mar corresponding connectors to a reduced degree.

An illustrative embodiment of the present invention may provide a connector insert having latches, bayonets, or similar structures as retention features. This connector insert may include these latches, bayonets, or similar structures on one or more sides or other portions of the connector insert. These bayonets may be located inside of a connector insert when the connector insert is being inserted into a receptacle, thereby reducing wear and marring of the receptacle. The bayonets may extend from the connector insert when the connector insert is inserted into the connector receptacle to secure the connector insert in place in the connector receptacle. The bayonets may engage corresponding retention features in the connector receptacle, thereby reducing the chances of an inadvertent disconnection. When the bayonets are located inside the connector insert, the connector insert may be in a first state, while when the bayonets extend beyond the connector insert, the connector insert may be in a second state. The connector insert may retain state in either the first or second state in the absence of a user applied force.

In a specific embodiment of the present invention, a plunger may extend beyond an end of the connector insert when in the connector insert is in the first state. When the plunger is depressed into the connector insert, the connector insert may change state from the first state to be second state.

For example, when the connector insert is inserted into a connector receptacle, the plunger may be extended, and the connector insert may be in the first state. In this first state, the bayonets are inside the connector insert and are not exposed. Therefore, the bayonets do not wear or mar the connector receptacle during insertion. As the connector insert is inserted, the plunger may engage a back of a connector receptacle. This engagement may depress the plunger, thereby moving the connector insert from a first state to a second state. In this second state, the bayonets extend outside of the connector insert, and may engage surfaces in the connector receptacle. The engagement between the bayonets and surfaces in the connector receptacle may provide a retention force and may reduce the likelihood of an inadvertent extraction.

As the connector insert is extracted, a user may apply a force to one or more sides of a housing. This may cause the bayonets to be depressed and move inside the connectors insert. This may disengage the bayonets from the surfaces in the connector receptacle and allow the connector insert to be removed. The force applied to one or more sides of the housing may further also cause or allow the plunger to move such that it is extended beyond an end of the connector insert. As the connector insert is removed in this way, the connector insert returns to the first state from the second state.

In normal operation, as the connector insert is inserted, the plunger may be depressed when it encounters a rear of a connector receptacle. However, since this plunger is exposed, it may be depressed by a user, either purposefully or inadvertently before the connector insert is inserted. This may put the connector insert in a second state, even though it is not inserted into a connector receptacle. When the connector insert is in the second state and is inserted into the connector receptacle, the bayonets may engage sides of the connector receptacle. However, since this is likely only an occasional occurrence, wear and marring on the connector receptacle is at least reduced by the incorporation of embodiments of the present invention.

In a specific embodiment of the present invention, the plunger may be spring biased such that the plunger is extended when a user applies force to one or more sides of the connector insert housing. That is, the plunger is pushed by the spring to extend beyond an end of the connector insert when the user applied force is exerted. Each bayonet may be connected to an arm. The arms may be connected together to form a retention feature, or they may be separate. Either or both arms may include an opening. The plunger may include one or more pins, each pin aligned to an opening in the arms or retention feature. The pins may be in a first location in the opening when a connector insert is in a first state, while the pins may be in a second location in the opening when the connector insert is in a second state.

In these examples, wear and marring of a connector receptacle may be reduced by employing bayonets that remain inside a connector insert until a connector insert is inserted in to the connector receptacle. In other embodiments of the present invention, retention features in a connector receptacle may engage surfaces in one or more openings on a connector insert. This may transfer the wear and marring from the connector receptacle to the connector insert, which may be of less concern to a user. In an illustrative embodiment of the present invention, the connector insert may include a connector insert portion having side openings. The connector insert portion may be attached to a housing having one or more side buttons or other movable or flexible portion. During insertion, retention features in a connector receptacle may engage the side openings, thereby securing the connector insert in place in the connector receptacle. During removal, a user may push one or more buttons. This action may push the retention features in the connector receptacle out of the side openings, thereby allowing the removal of the connector insert.

Embodiments of the present invention may be used in connector inserts and receptacles for cables that may connect to various types of devices, such as portable computing devices, tablets, desktop computers, laptops, all-in-one computers, cell phones, smart phones, media phones, storage devices, portable media players, navigation systems, monitors, power supplies, adapters, and chargers, and other devices. These connector inserts may provide pathways for signals and power compliant with various standards such as Universal Serial Bus (USB), a High-Definition Multimedia Interface (HDMI), Digital Visual Interface (DVI), power, Ethernet, DisplayPort, Thunderbolt, Lightning and other types of standard and non-standard interfaces.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
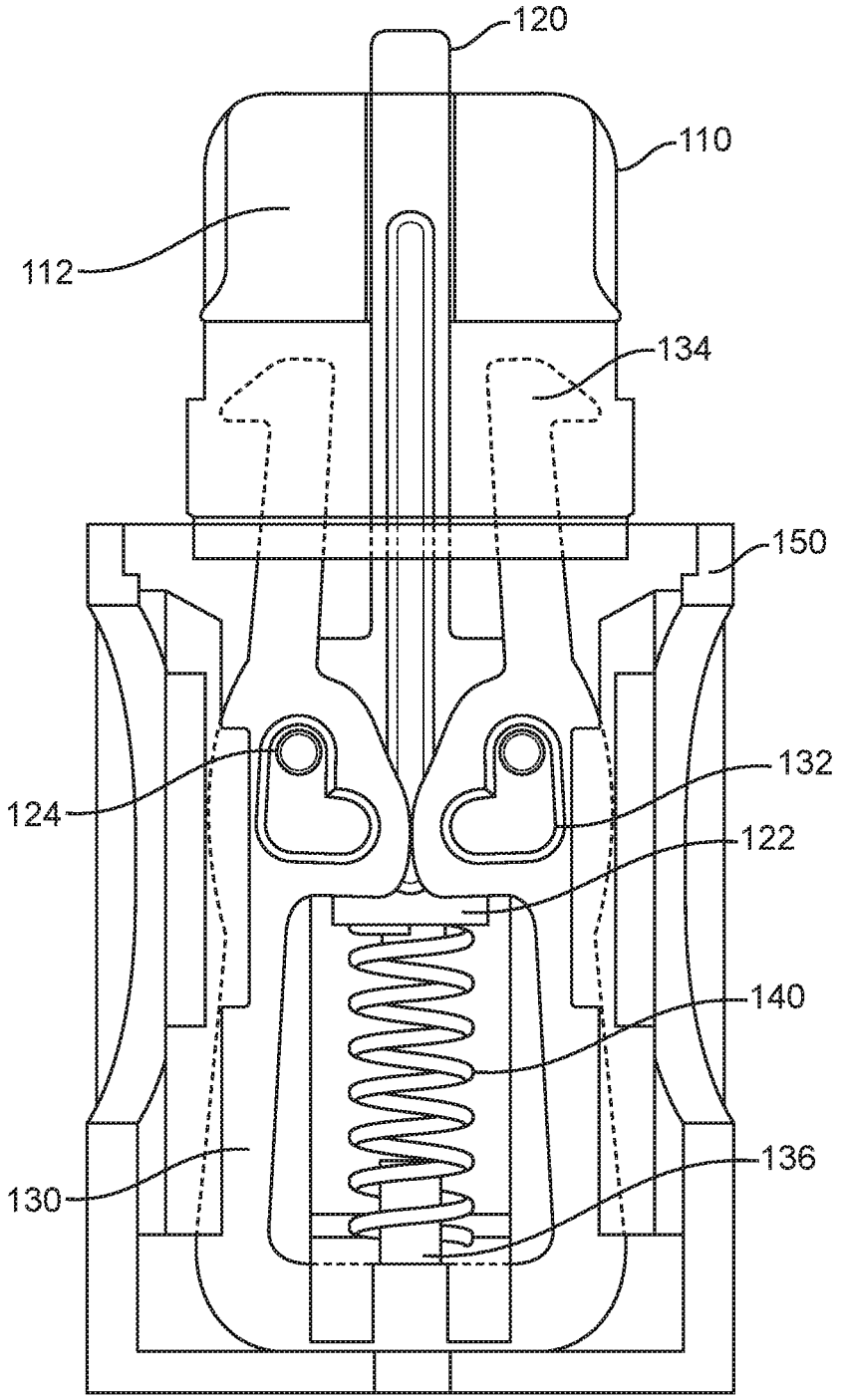
FIG. 1 illustrates a cross-section of a connector insert according to an embodiment of the present invention where the connector insert is in a first state.

FIG. 1 illustrates a cross-section of a connector insert according to an embodiment of the present invention where the connector insert is in a first state. This figure, as with the other included figures, is shown for illustrative purposes and does not limit either the possible embodiments of the present invention or the claims.

This connector insert may include an insert portion 110 having a top surface 112 and a bottom surface (not shown.) The top 112 and bottom surfaces may each provide support or locations for a number of contacts to mate with corresponding contacts in a corresponding connector receptacle.

Retention feature 130 may include two arms, each terminating in a latch, bayonet, or similar structure. Bayonets 134 may be inside insert portion 110 when a connector insert is in a first state, while bayonets 134 may extend beyond an outside surface of connector insert portion 110 when the connector insert is in a second state.

This connector inserts may further include plunger 120. Plunger 120 may extend beyond an edge of connector insert portion 110 when a connector insert is in the first state. When the connector insert is inserted into a connector receptacle, plunger 120 may be depressed and pushed into connector insert portion 110, thereby moving the connector insert into a second state. Plunger 120 may be spring biased by spring 140. Spring 140 may push plunger 120 upward as shown beyond an end of connector insert portion 110 when the connector insert is in the first state. Spring 140 may be held in place by tabs 122 on plunger 120 and 136 on the retention feature 130.

Plunger 120 may include one or more pins 124. These pins may be in different locations in opening 132 on retention feature 130 when the connector insert is in the first and second state. That is, they may be in a first location when the connector insert is in the first state and they may be in a second location when the connector insert is in the second state. They may pass through a third position when transitioning between the first and second states.

In the figure as shown, pins 124 may be located near a top of openings 132, that is, they may be in the first location. Spring 140 may apply a force to ensure that plunger 120 extends beyond an end of connector insert portion 110 and that the pins 124 remain in the first position in openings 132. This may maintain pins 124 in this location in openings 132 in retention feature 130. This first state may be stable in the connector insert may remain in this position in the absence of any user applied force.

Figure 2:
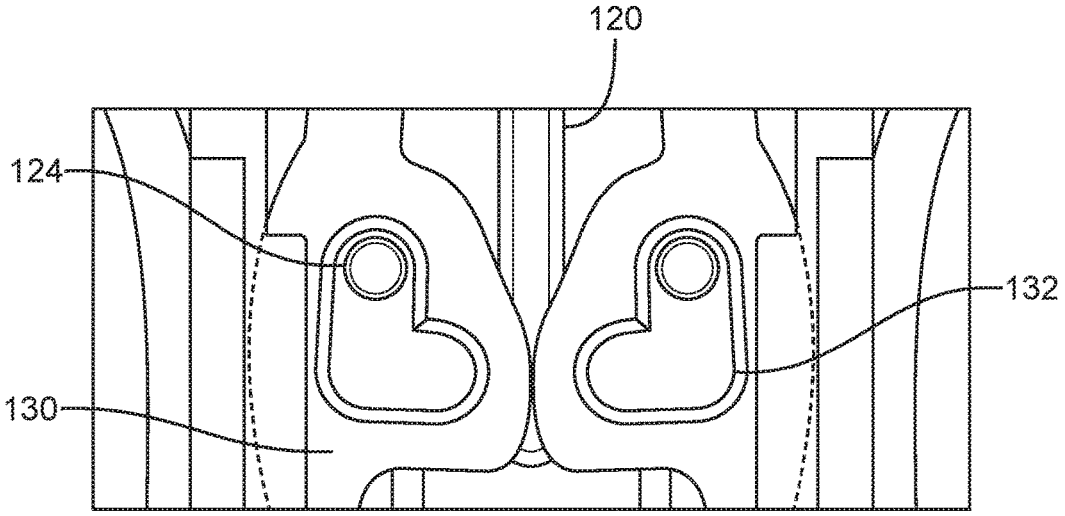
FIG. 2 illustrates a close-up of a portion of a connector insert according to an embodiment of the present invention.

FIG. 2 illustrates a close-up of a portion of a connector insert according to an embodiment of the present invention. In this figure, pins 124 located on plunger 120 are located in a first position in openings 132 of retention feature 130. Pins 124 may be stamped, molded, or otherwise formed with the plunger 120. In other embodiments of the present invention, pins 124 may be separately formed and attached, soldered, or otherwise fixed to plunger 120.

As plunger 120 is depressed, for example by engaging a rear of a connector receptacle, pins 124 may be pushed down towards a bottom of opening 132. An example of this is shown in the following figure.

Figure 3:
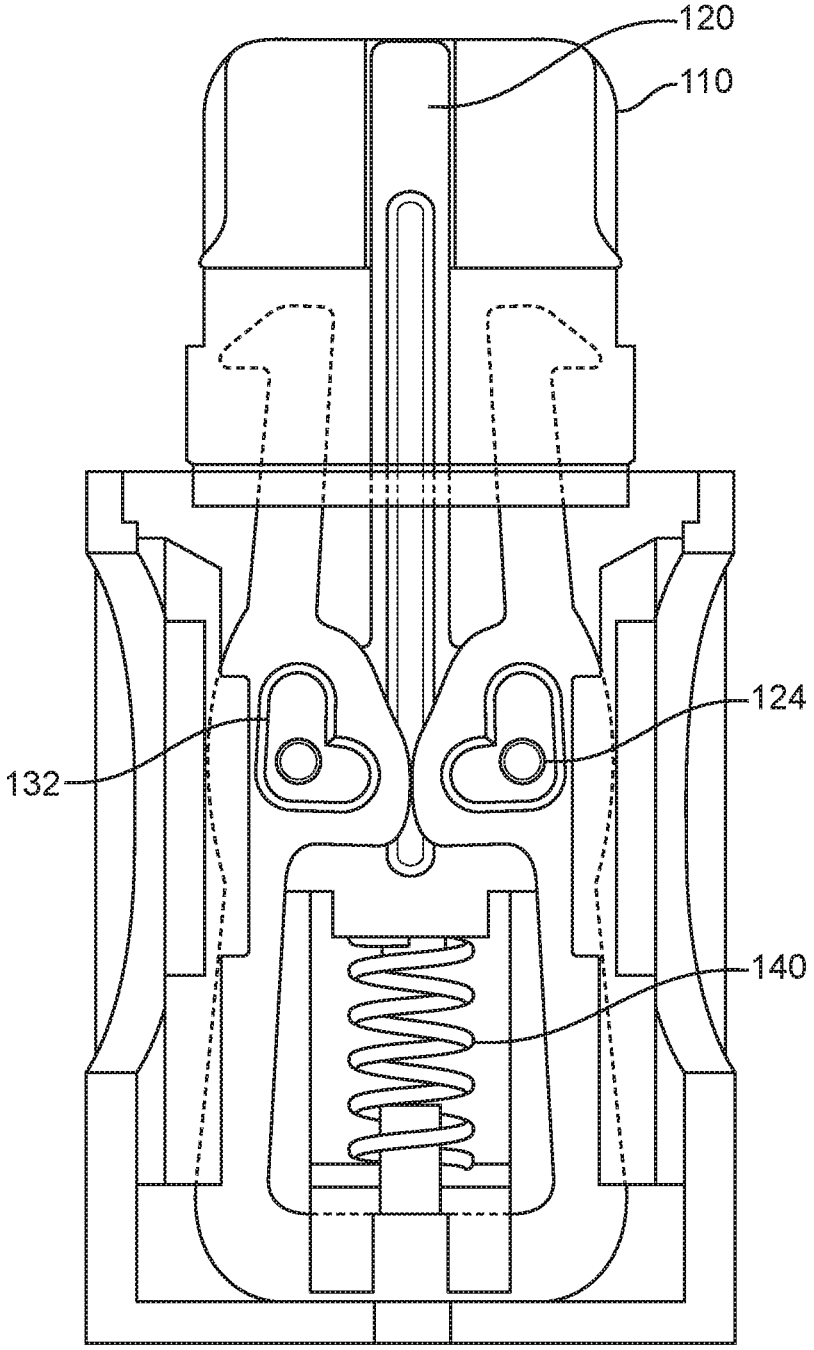
FIG. 3 illustrates a connector insert according to an embodiment of the present invention where the connector insert is transitioning between a first state and a second state.

FIG. 3 illustrates a connector insert according to an embodiment of the present invention where the connector insert is transitioning from a first state to a second state. In this figure, plunger 120 has been depressed to an edge of connector insert portion 110. Each pin 124 has been moved to a bottom of openings 132 (the third position) and spring 140 is depressed. When the connector insert is in this position, a pre-bias force between the arms of retention feature 130 act to push the arms away from each other. This may expose the bayonets such that they may engage surfaces in a connector receptacle. This second state is shown in the following figure.

Figure 4:
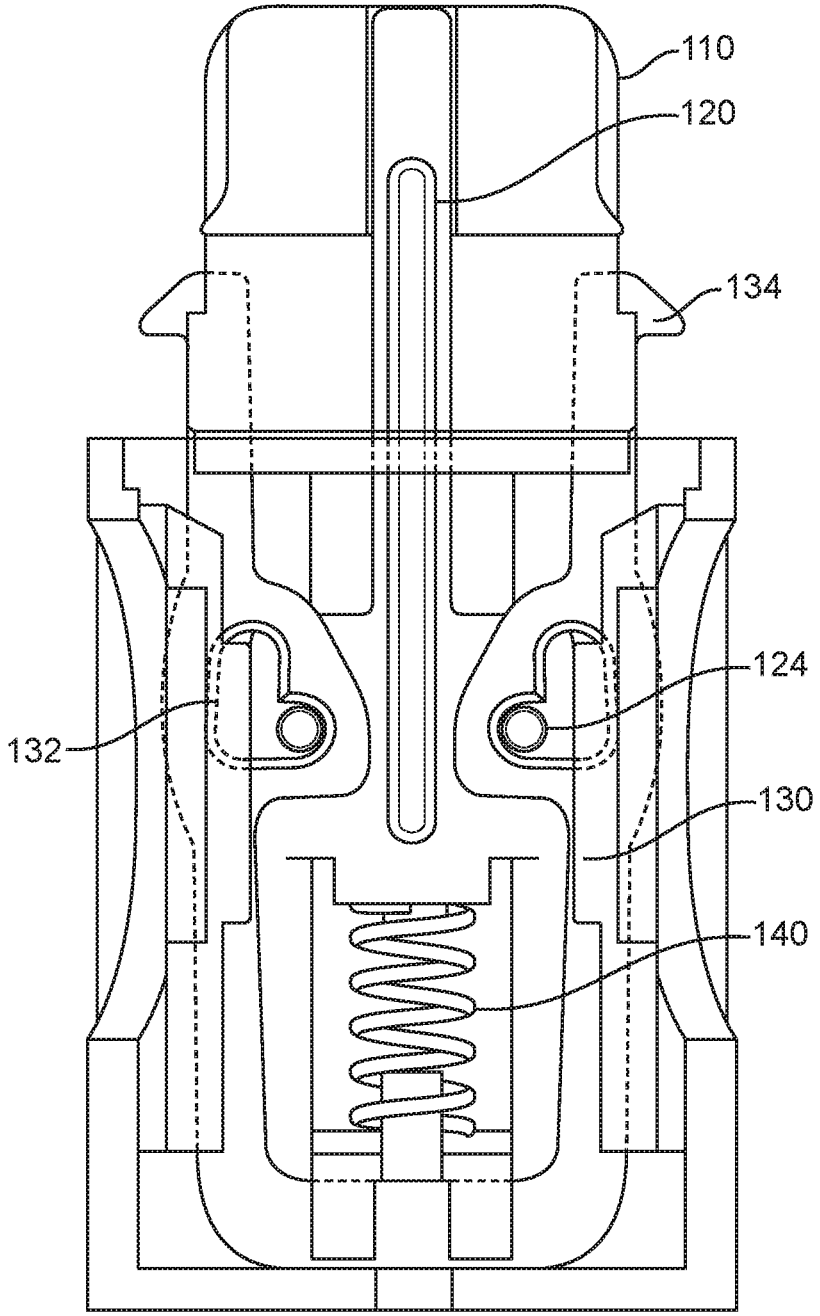
FIG. 4 illustrates a connector insert according to an embodiment of the present invention, where the connector insert is in a second state.

FIG. 4 illustrates a connector insert according to an embodiment of the present invention, where the connector insert is in a second state. In this second state, bayonets 134 may extend beyond a surface of connector insert portion 110. Again, the pre-bias force between the arms of retention feature 130 acts to push the arms away from each other. This lateral movement may be limited by the size of a bottom portion of opening 132 in retention feature 130. Specifically, the arms of retention feature 130 may move outward until sides of openings 132 in retention feature 130 engage pins 124. In this second position, spring 140 may remain compressed and plunger 120 may remain depressed. Bayonets 134 may remain exposed where they may engage surfaces in a connector receptacle to secure the connector insert in place in a connector receptacle.

In various circumstances, plunger 120 may be depressed not by the back of a connector receptacle, but by a user or other surface. In this situation, it may be desirable to insert the connector insert into a receptacle while the connector insert is in this second state. While this connector insert is in the second state, bayonets 134 may engage surfaces of a connector receptacle during insertion. This may cause some wear and marring in the connector receptacle. However, since this is not the typical use, the wear and marring of the connector receptacle may be reduced by the incorporation of embodiments of the present invention.

To extract the connector insert when it is in this second state, a user may press on an outside of housing 150, thereby pushing arms of retention feature 130 together. That is, a force may be applied by a user to retention feature 130 to overcome the pre-bias of retention feature 130 that keeps the two arms apart. In various embodiment of the present invention, the outside of housing 150 may include one or more pliable portions or surfaces such that a user may apply this force to retention feature 130. As the arms of retention feature 130 approach each other, pins 124 may move back to the third position in openings 132. This may allow plunger 120, which is pushed by spring 140, to move upwards as shown such that plunger 120 extends beyond inset portion 110, thereby returning the connector insert to the first state as shown above.

An example illustrating the insertion of a connector insert is shown in the following figure.

Figure 5:
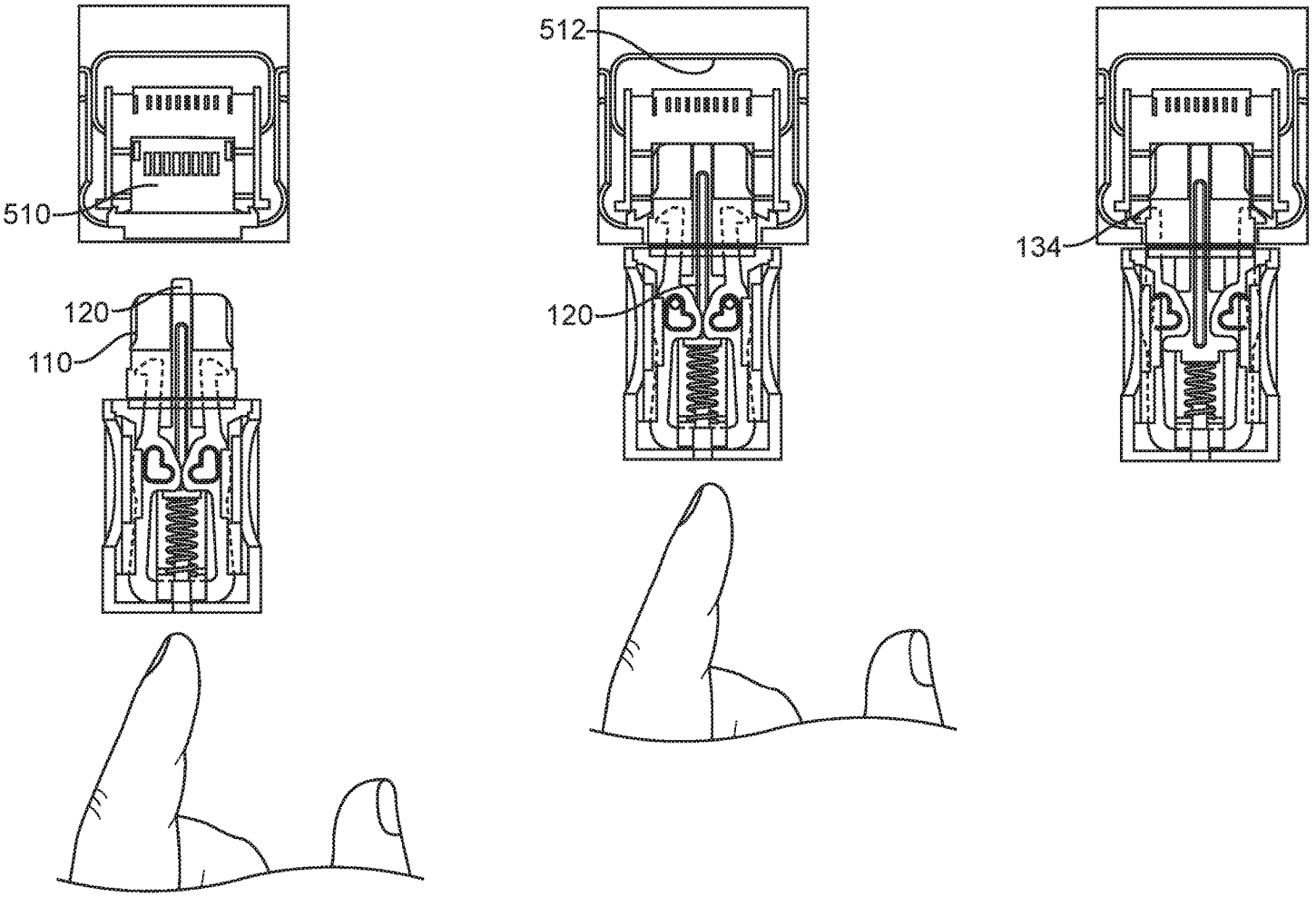
FIG. 5 illustrates the insertion of a connector insert into a connector receptacle according to an embodiment of the present invention.

FIG. 5 illustrates the insertion of a connector insert into a connector receptacle according to an embodiment of the present invention. In this figure, plunger 120 initially extends beyond an end of connector insert portion 110. As the connector insert is inserted into connector receptacle 510, plunger 120 may encounter a back of receptacle 512. This may depress plunger 120. The depression of the plunger 120 may allow bayonets 134 to extend beyond a surface of connector insert portion 110. Bayonets 134 may then engage corresponding surfaces and connector receptacle 510, thereby holding a connector insert in place in connector receptacle 510.

Again, the connector insert may be extracted when a user applies a lateral force through a housing of the connector insert and extract the connector insert. An example is shown in the following figure.

Figure 6:
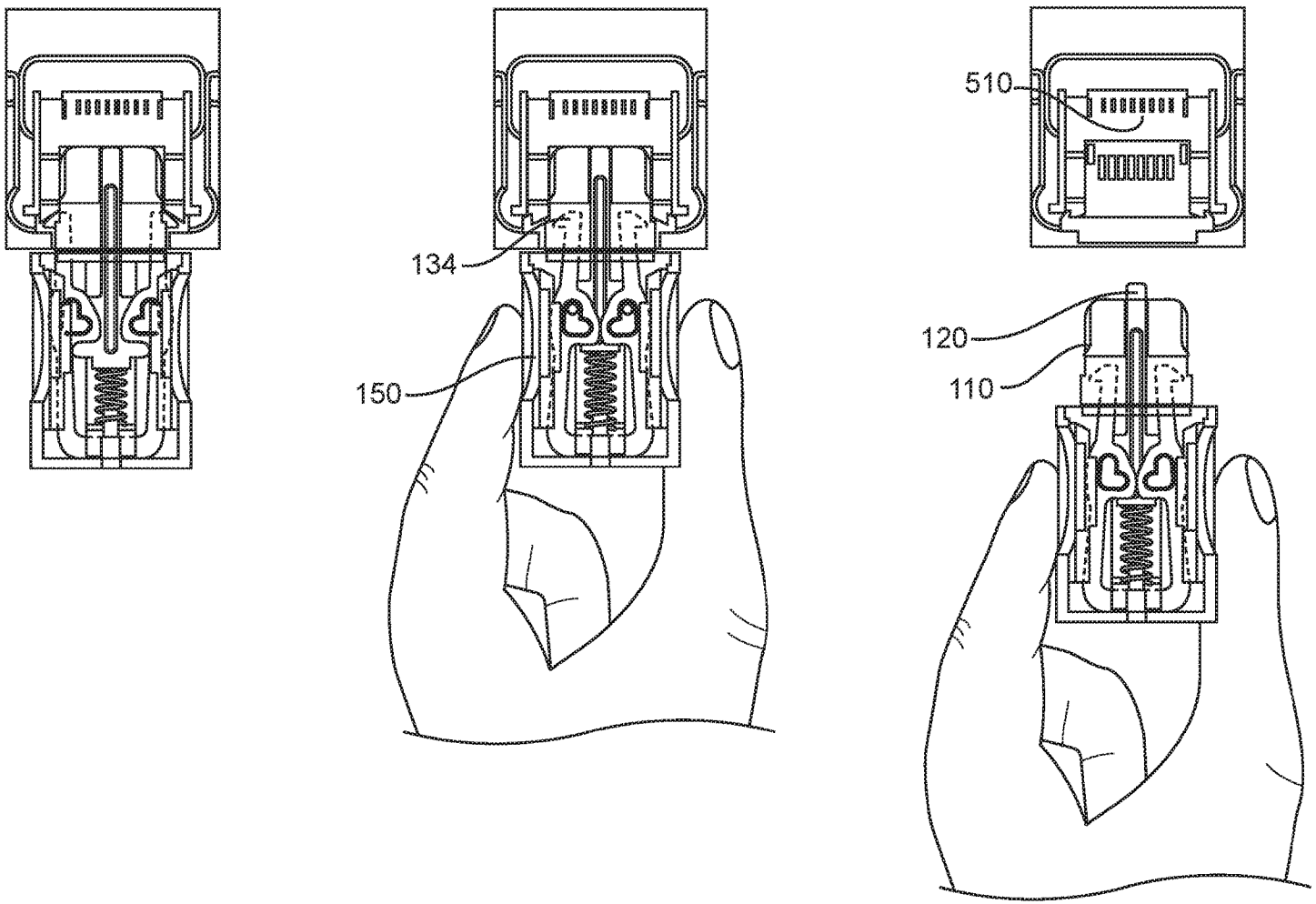
FIG. 6 illustrates the extraction of a connector insert from a connector receptacle according to an embodiment of the present invention.

FIG. 6 illustrates the extraction of a connector insert from connector receptacle 510 according to an embodiment of the present invention. Again, a user may apply a lateral force to one or more sides of housing 150 of connector insert. This may force arms of retention feature 130 to move closer together, thereby moving bayonets 134 inside of connector insert portion 110. Spring 140 may force plunger to move upward as shown such that it extends beyond an end of connector insert portion 110.

In various embodiment of the present invention, these springs, retention features, plungers, and others component may be formed in various ways. For example, spring 140 may be formed as part of plunger 120. An example is shown in the following figure.

Figure 7:
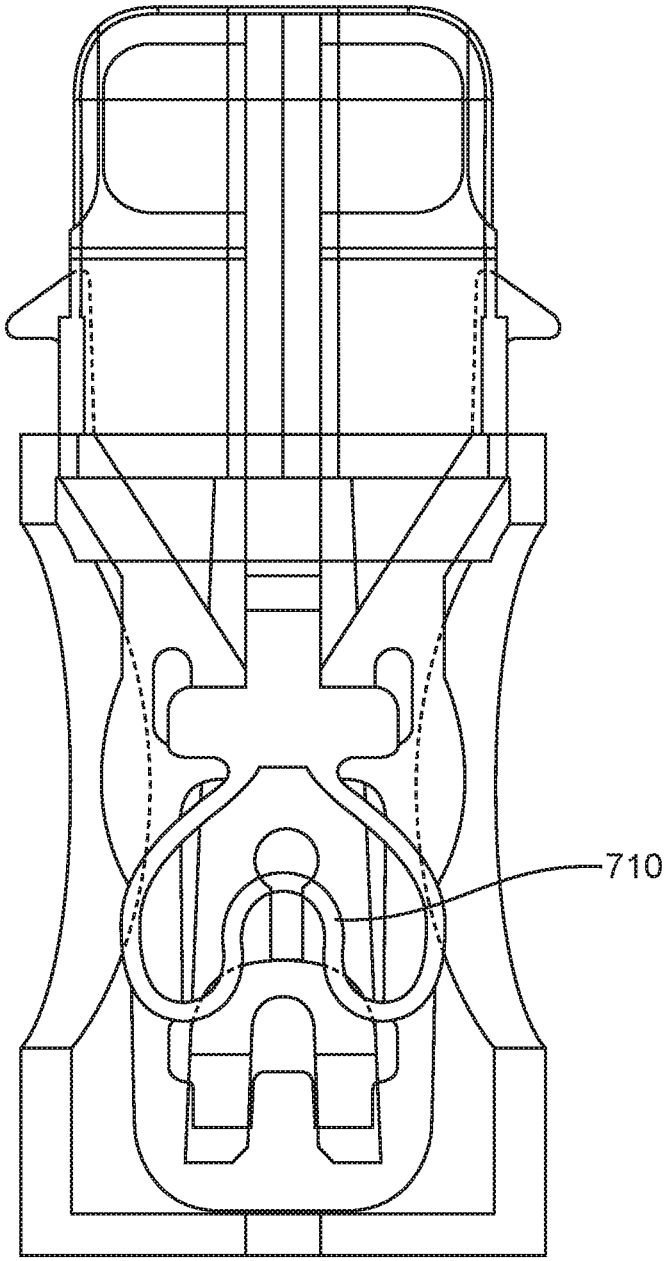
FIG. 7 illustrates another connector insert according to an embodiment of the present invention.

FIG. 7 illustrates another connector insert according to an embodiment of the present invention. In this example, a spring for a plunger is formed as part of plunger 710. This and other springs may be included and used to provide additional force to push arms of retention feature 130 away from each other, either to replace or supplement a pre-biasing. In still other embodiments, the retention feature and spring, spring and plunger, plunger and retention feature, or spring, retention feature, and plunger may be formed together as a unit or separately. These may be formed by stamping, machining, 3-D printing, metal-injection molding, or other technique.

In various embodiment of the present invention, other features may be included to further reduce marring and wear of a connector receptacle. An example is shown in the following figure.

Figure 8:
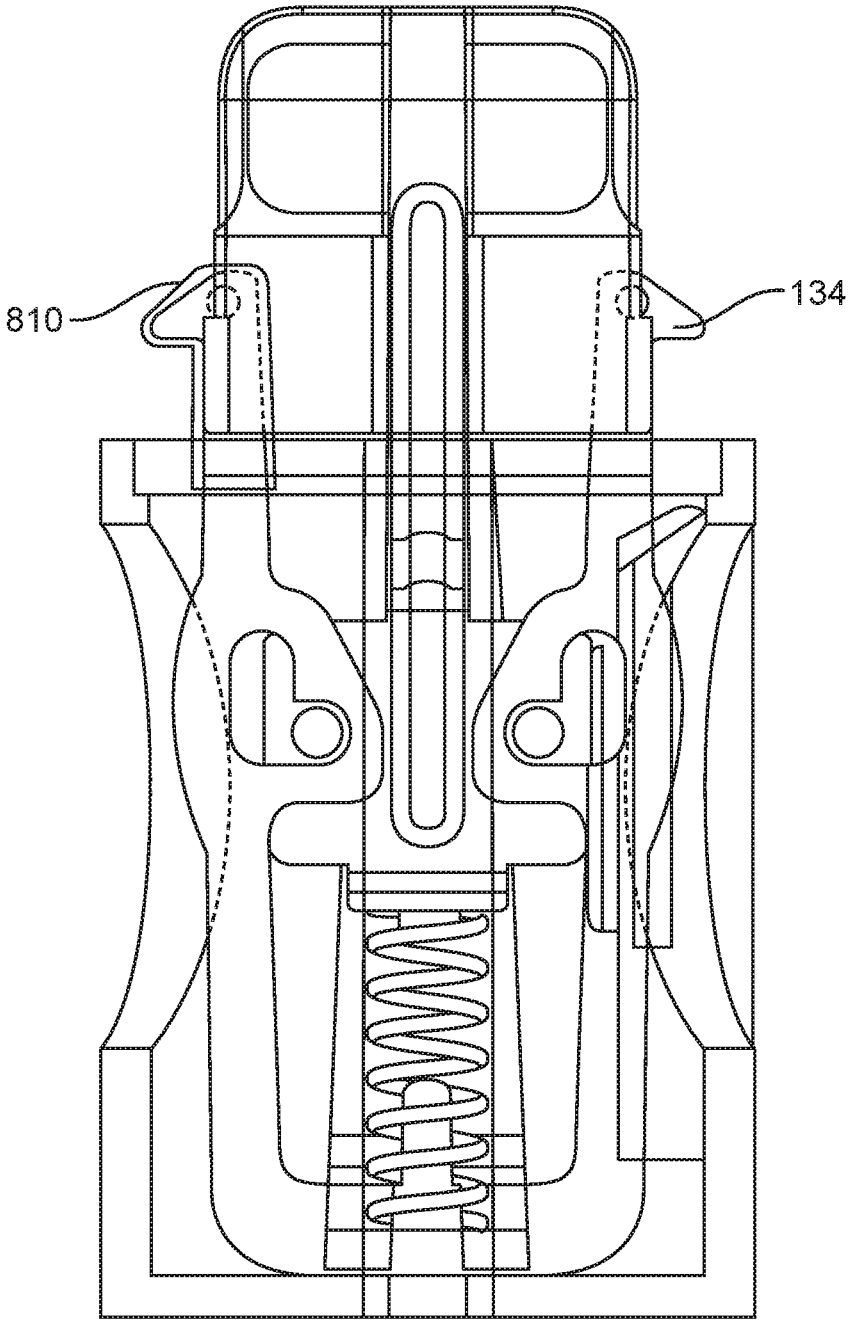
FIG. 8 illustrates a connector insert having additional wear protection according to an embodiment of the present invention.

FIG. 8 illustrates a connector insert having additional wear protection according to an embodiment of the present invention. In this example, layer or shield 810 may be formed around a bayonet 134. Shield 810 may be a coating, layer, or boot-type object formed of plastic, resin, rubber, or other appropriate non or limited-marring material. While layer or shield 810 is shown on only one bayonet 134, such layer or shields 810 may be located on some of all of the bayonets 134 on a connector insert.

Figure 9:
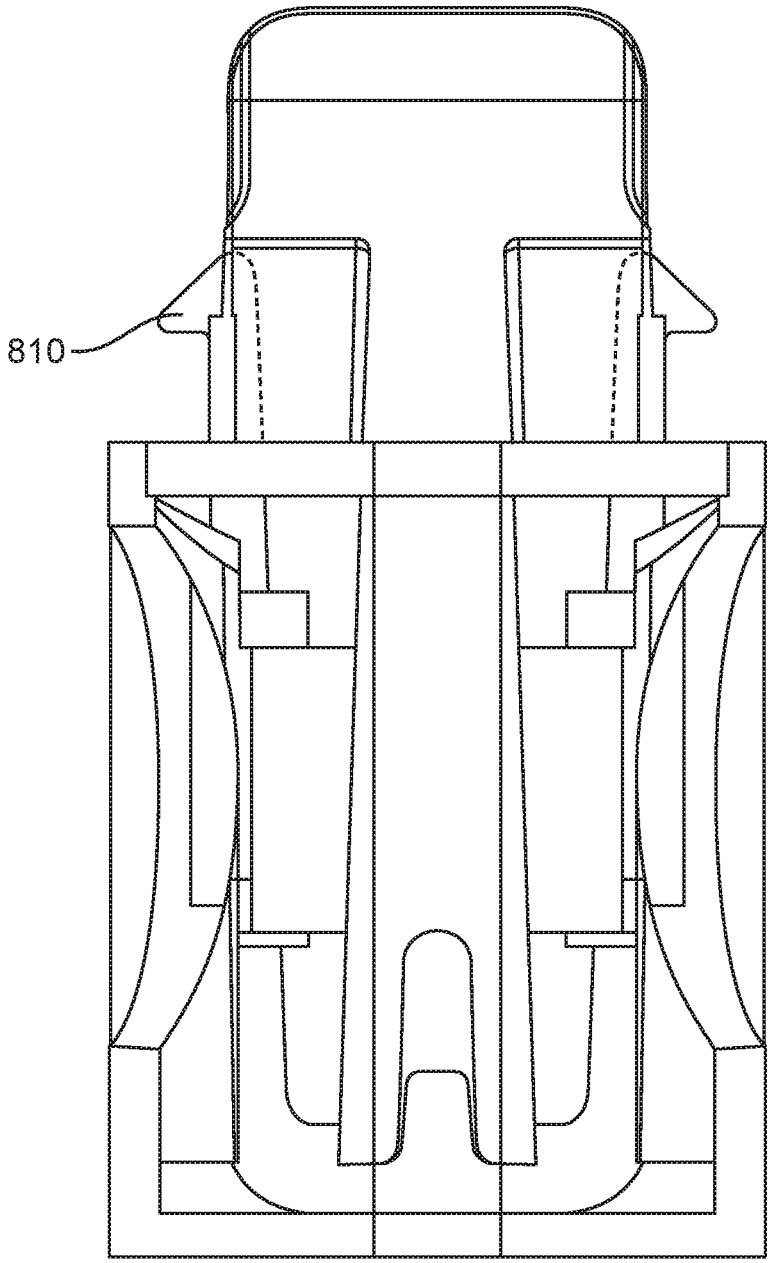
FIG. 9 illustrates a connector insert having additional wear protection according to an embodiment of the present invention.

FIG. 9 illustrates a connector insert having additional wear protection according to an embodiment of the present invention. In this figure, shield 810 is shown on both bayonets.

In the above examples, wear and marring of a connector receptacle may be reduced by employing bayonets that remain inside a connector insert until a connector insert is inserted in to the connector receptacle. In other embodiments of the present invention, retention features in a connector receptacle may engage surfaces in one or more openings on a connector insert. This configuration may transfer the wear and marring from the connector receptacle to the connector insert, which may be of less concern to a user. An example is shown in the following figure.

Figure 10:
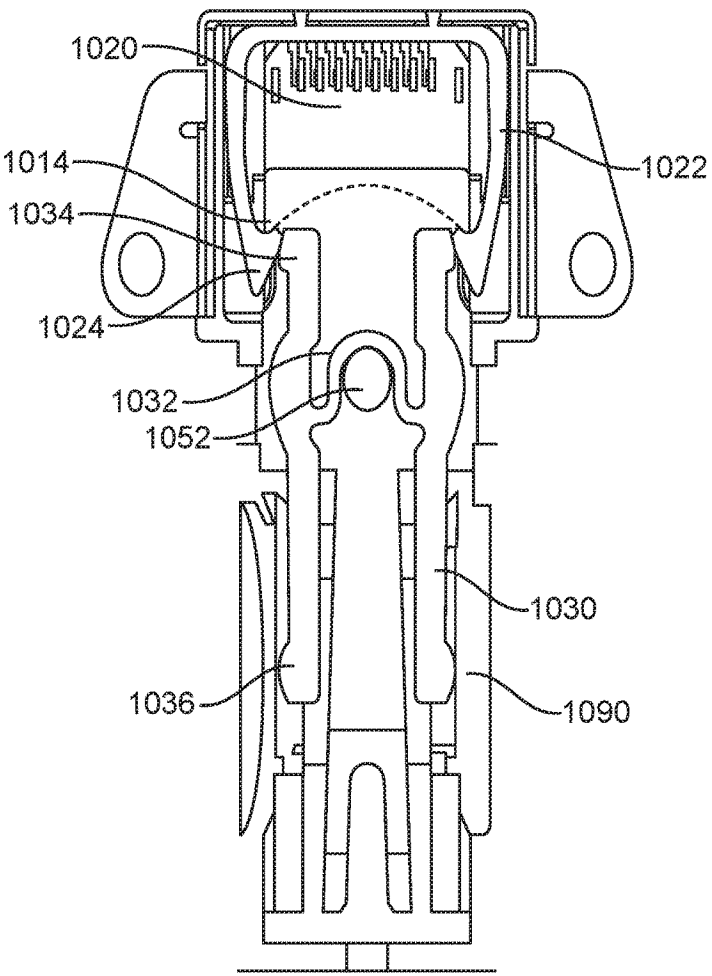
FIG. 10 illustrates another connector system according to an embodiment of the present invention.
Figure 10:
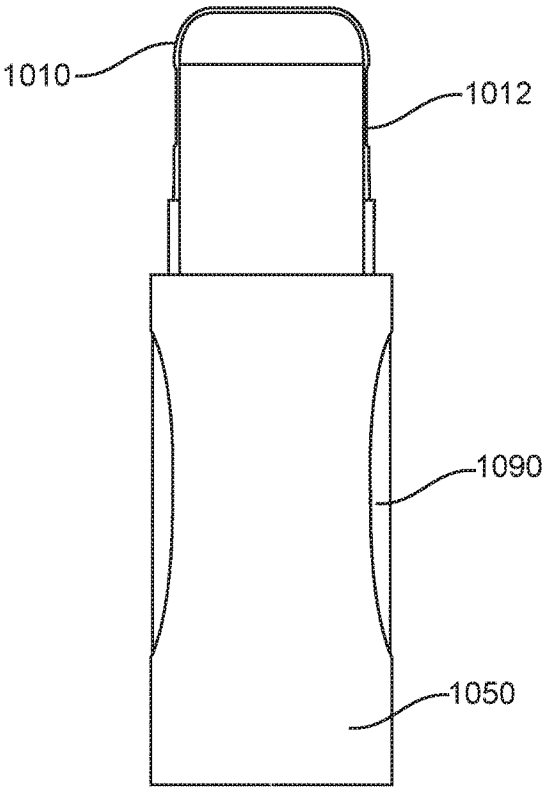

FIG. 10 illustrates a connector system according to another embodiment of the present invention. The connector insert may include a connector insert portion 1010 having side openings 1012. Connector insert portion 1010 may have contacts to mate with contacts in connector receptacle 1020 and may be attached to connector housing 1050. Connector housing 1050 may include one or more side buttons or other movable or flexible portion 1090.

During insertion, retention features in a connector receptacle may engage side openings 1012, thereby securing the connector insert in place in the connector receptacle. During removal, a user may push one or more buttons 1090. This action may push the retention features in the connector receptacle out of side openings 1012, thereby allowing the removal of the connector insert.

More specifically, the connector insert may include two arms 1030 held together by connecting portion 1032. Connector portion 1032 may be held in place by pivot point 1052. Connector receptacle 1020 may include retention bracket 1022 having retention hooks 1024.

When the connector insert is inserted into receptacle 1020, retention hooks 1024 may engage connector insert portion 1010. The engagement of connector insert portion 1010 by the sloped leading edges of retention hooks 1024 may cause retention hooks 1024 to move in an outward direction. As retention hooks 1024 engage side opening 1012 on the connector insert portion 1010, retention hooks 1024 may enter side openings 1012 and engage surface 1014 of side opening 1012. This engagement may secure the connector insert in place in connector receptacle 1020.

During extraction of the connector insert, a user may apply a lateral force one or more buttons or other surfaces 1090. This may apply an inward force on portion 1036 of arms 1030. This inward force may be translated by pivot point 1052 to an outward force at portion 1034 of arms 1030. This outward force may act to move retention hooks 1024 out of side openings 1012 in connector insert portion 1010. At this time, the connector insert may be removed.

In this configuration, while retention hooks 1024 may engage and wear surfaces on the connector insert, connector receptacle 1020 and the electronic device housing connector receptacle 1020 should remain substantially free of wear and marring.

Figure 11:
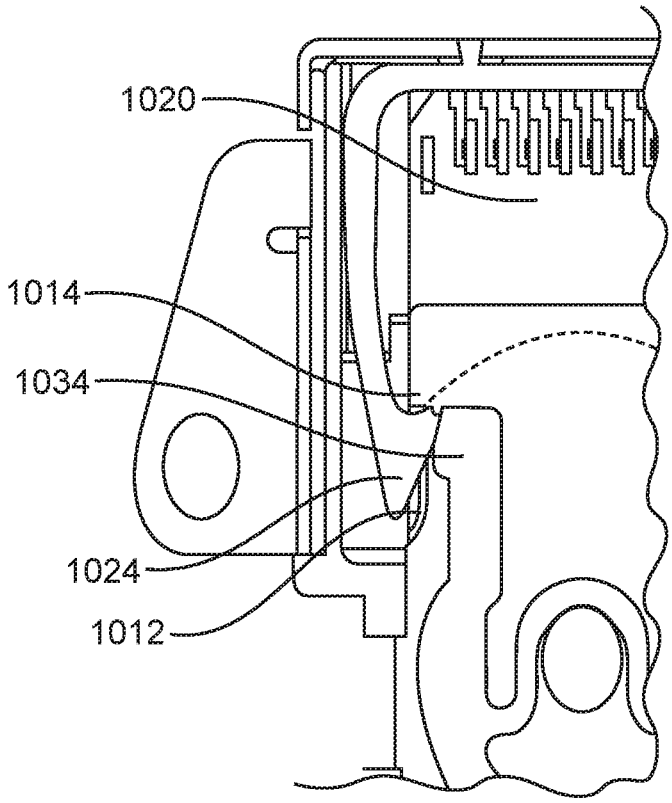
FIG. 11 illustrates a close-up view of a portion of a connector system according to an embodiment of the present invention and FIG. 12 illustrates a connector insert according to an embodiment of the present invention, where the connector insert is secured to a user and inserted into an electronic device.

FIG. 11 illustrates a close-up view of a portion of a connector system according to an embodiment of the present invention. In this figure, an inside edge of retention hooks 1024 engage surfaces 1014 of side opening 1012 to secure the connector insert in place in connector receptacle 1020. Portion 1034 of arm 1030 may act to push retention hook 1024 out of side opening 1012 during removal of the connector insert. During insertion, retention hooks 1024 may be pushed laterally outward until they reach side opening 1012. At that point, retention hooks 1024 may enter side openings 1012 and engage surface 1014.

Figure 12:
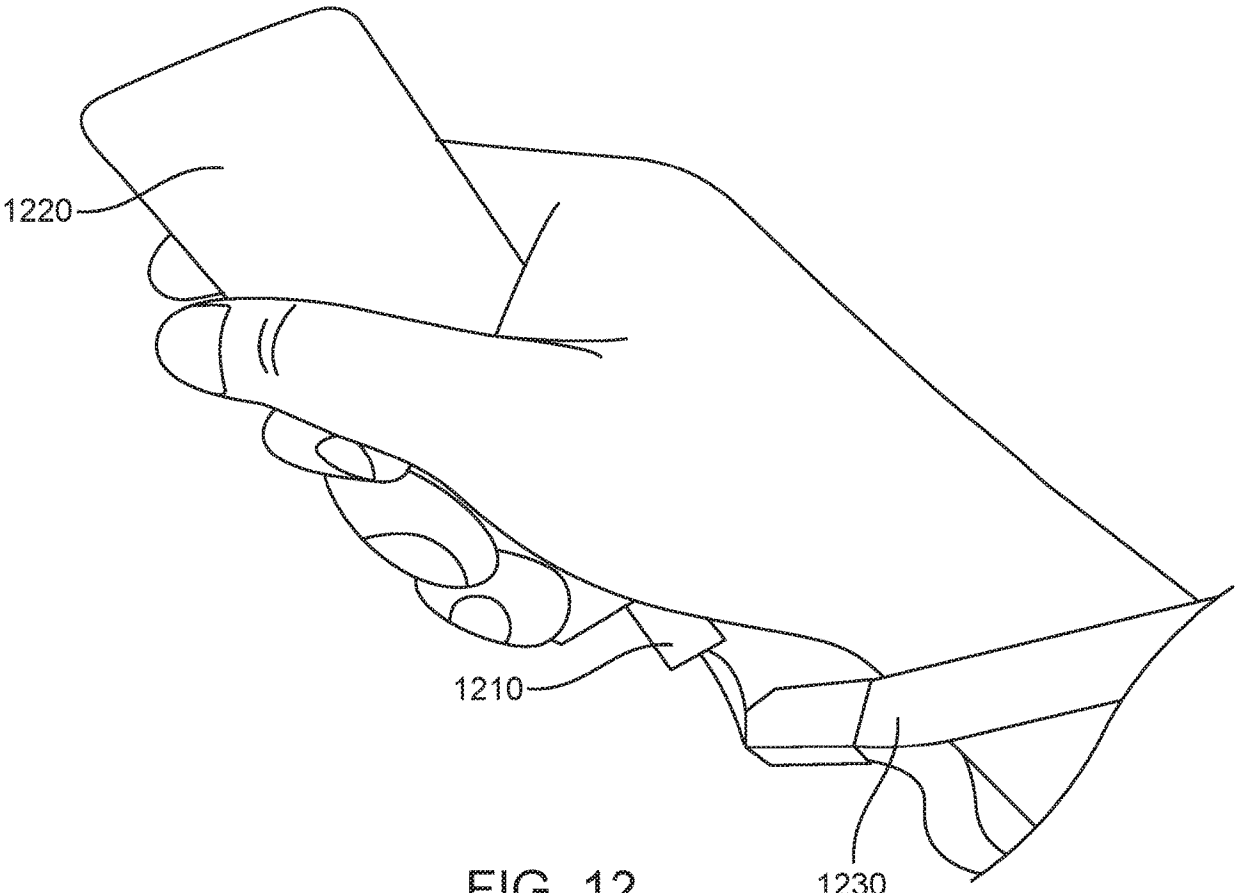

FIG. 12 illustrates a connector insert according to an embodiment of the present invention, where the connector insert is secured to a user and inserted into an electronic device. Specifically, connector insert 1210 may be inserted in portable electronic device 1220. Wrist strap 1230 may be attached to connector insert 1210 and may wrap around a user's wrist. This arrangement may help prevent portable electronic device 1220 from being dropped. Specifically, if user loses a grip on portable electronic device 1220, wrist strap 1230 and connector insert 1210 may prevent portable electronic device 1220 from hitting the ground.

In other embodiments of the present invention, wrist strap 1230 may be replaced or supplemented by a lanyard, clips, pins, clip with retractable cord, or other device. Portable electronic device may be a portable computing device, tablet, laptop, cell phone, smart phone, media phone, storage device, portable media player, or other electronic device.

Embodiments of the present invention may also be used to enhance security. For example, a connector insert according to an embodiment of the present invention may be used where an electronic device may be accessible to third parties, such as in a retail or office environment. Since such a third party cannot simply pull the connector insert to remove it, locking features provide by the connector insert may dissuade the third party from a theft attempt.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector insert comprising:

an insert portion to fit in a connector receptacle;

two arms, each arm terminating in a bayonet, where each bayonet has two possible positions including a first position at least substantially inside the insert portion and a second position at least substantially outside the insert portion; and a housing behind the insert portion, wherein the first position and the second position are latched positions where either position is maintained in the absence of a user supplied force.

2. A connector insert of claim 1 wherein the housing is configured to be grasped by a user during insertion of the connector insert into the connector receptacle and during extraction of the connector insert from the connector receptacle.

3. The connector insert of claim 1 further comprising a plunger, where an end of the plunger extends beyond an end of the insert portion when the bayonets are in the first position and the plunger does not extend beyond the end of the insert portion when the bayonets are in the second position.

4. The connector insert of claim 3 wherein the plunger is spring-biased.

5. The connector insert of claim 4 wherein each arm includes an opening and the plunger includes at least two pins, each pin aligned in the opening in a corresponding arm.

6. The connector insert of claim 5 wherein each pin on the plunger is in a first location in the opening when the bayonets are in the first position and the pin on the plunger is in a second location in the opening when the bayonets are in the first position.

7. The connector insert of claim 6 wherein when the connector insert is inserted into the connector receptacle, the plunger is depressed and the bayonets are moved to the second position.

8. The connector insert of claim 7 wherein when the connector insert is extracted from the connector receptacle, the user pushes the arms together and the bayonets move to the first position.

9. The connector insert of claim 8 wherein the user depresses two buttons, one on each side of the housing, to push the arms together.

10. The connector insert of claim 1 further comprising a lanyard attached to the housing.

11. The connector insert of claim 1 further comprising a retention feature formed as a single piece and comprising the two arms, each arm terminating in a bayonet.

12. A connector insert comprising:

an insert portion to fit in a connector receptacle, the insert portion having side openings;

a retention feature formed as a single piece and comprising two arms, each arm terminating in a bayonet, where each bayonet has two possible positions including a first position inside the insert portion and a second position extending through the side openings of the insert portion; and a housing behind the insert portion, wherein the second position is maintained in the absence of a user supplied force and the bayonets move to the first position when a user applies force at sides of the housing.

13. The connector insert of claim 12 wherein the two arms are connected by a connecting portion.

14. The connector insert of claim 13 wherein the connecting portion is attached to a pivot point.

15. The connector insert of claim 12 wherein the housing is configured to be grasped by the user during extraction of the connector insert from the connector receptacle.

16. The connector insert of claim 12 further comprising a lanyard attached to the housing.

17. The connector insert of claim 12 wherein the bayonets move from the second position to the first position when the user applies force at buttons located on sides of the housing.

18. The connector insert of claim 12 wherein the housing comprises two buttons, one on each of two opposing sides of the housing, wherein when the buttons are depressed, the bayonets move to the first position.

19. The connector insert of claim 12 wherein the arms of the retention feature terminate in a bayonet at a first end and are joined together at a second end.

20. The connector insert of claim 19 wherein the housing comprises two buttons, one on each of two opposing sides of the housing, wherein when the buttons are depressed, the bayonets move from the second position to the first position.

21. A connector insert comprising:

an insert portion having side openings;

a retention feature including two arms, each arm terminating in a bayonet at a first end and joined together at a second end, where each bayonet has two possible positions including a first position inside the insert portion and a second position extending through the side openings of the insert portion; and a housing behind the insert portion, the housing including two buttons, one on each side of the housing, wherein when a button is in a depressed position, a bayonet on a corresponding arm is in the first position and when the button is not in a depressed position, the bayonet on the corresponding arm is in the second position.

22. The connector insert of claim 21 wherein the second position is maintained in the absence of a user supplied force.

23. The connector insert of claim 21 further comprising a lanyard attached to the housing.

24. The connector insert of claim 21 wherein the retention feature is formed as a single piece.

* * * * *